US005858325A

United States Patent [19]

Hall et al.

[11] Patent Number: 5,858,325

[45] Date of Patent: Jan. 12, 1999

[54] AGGLOMERATION OF ALUMINA MATERIAL

[75] Inventors: John Sydney Hall, Malvern; Barry James Robson, Riverton; Timothy Raymond Barton, Elsterwick, all of Australia

[73] Assignees: Commonwealth Scientific and Industrial Organisation, Campbell; Alcoa of Australia Limited, Melbourne, Australia

[21] Appl. No.: 290,950

[22] PCT Filed: Dec. 24, 1993

[86] PCT No.: PCT/AU93/00683

§ 371 Date: Aug. 22, 1994

§ 102(e) Date: Aug. 22, 1994

[87] PCT Pub. No.: WO94/14988

PCT Pub. Date: Jul. 7, 1994

[30] Foreign Application Priority Data

Dec. 24, 1992 [AU] Australia ..... PL6572

[51] Int. Cl.[6] ..... C01F 7/02; C22B 1/14

[52] U.S. Cl. ..... 423/625; 23/313 R

[58] Field of Search ..... 423/625; 23/313 R

[56] References Cited

U.S. PATENT DOCUMENTS

| | | | |
|---|---|---|---|
| 3,317,277 | 5/1967 | Cosgrove | 23/313 R |
| 3,466,142 | 9/1969 | Hambly | 23/313 R |
| 3,701,718 | 10/1972 | Papee et al. | 423/625 |
| 3,968,225 | 7/1976 | André et al. | 423/625 |
| 4,124,699 | 11/1978 | Michel et al. | 423/625 |
| 4,159,969 | 7/1979 | Moné et al. | 423/625 |
| 4,579,728 | 4/1986 | Schoenthal et al. | 423/628 |
| 4,657,880 | 4/1987 | Lachman et al. | 502/263 |
| 4,894,189 | 1/1990 | Dave et al. | 23/313 R |
| 5,296,177 | 3/1994 | Thé et al. . | |

FOREIGN PATENT DOCUMENTS

| | | | |
|---|---|---|---|
| B1-27 048/77 | 1/1979 | Australia . | |
| 2124711 | 5/1990 | Japan | 423/625 |
| 1295133 | 11/1972 | United Kingdom . | |
| PCT/CA92/00202 | 5/1992 | WIPO . | |

OTHER PUBLICATIONS

P. Brand, P. Dietzmann, "Amorphous" Precursors of $\alpha$–$A1_2O_3$: An Electron Optical Study, *Cryst. Res. Technol.*, 1992, pp. 529–534, No Month.

Abstract of Japanese No. 5–171302 (A), dated Jul. 9, 1993.

Abstract of Japanese No. 5–171303 (A), dated Jul. 9, 1993.

Abstract of Japanese No. 5–171304 (A), dated Jul. 9, 1993.

Abstract of U.S. Patent No. 4,075,067, Feb. 1978.

Abstract of Great Britain Patent No. GB 1371068, Dec. 1971.

Abstract of European Patent No. EP 199396, Oct. 1986.

Abstract of European Patent No. EP 25900, Apr. 1981.

Abstract of Great Britain Patent No. GB1420554, Mar. 1974.

Abstract of Great Britain Patent No. GB 1418445, Mar. 1973.

Abstract of U.S. Patent No. 4,797,271, Jan., 1989.

Abstract of U.S. Patent No. 4,704,378, Nov., 1987.

Abstract of U.S. Patent No. 3,853,789, Dec. 1974.

Abstract of European Patent No. EP 387109, Sep. 1990.

Abstract of European Patent No. EP 34889, Sep. 1981.

Abstract of Great Britain Patent No. GB 2080273, Feb., 1982.

*Primary Examiner*—Steven Bos

*Attorney, Agent, or Firm*—Merchant, Gould, Smith, Edell, Welter & Schmidt, P.A.

[57] ABSTRACT

A process for the agglomeration of powder or dust of alumina containing material (herein referred to as "alumina powder"), wherein an aqueous slurry of the alumina powder is formed, the slurry containing a sufficient quantity of an inorganic binder comprising a polymer form of a hydroxy salt of aluminum. The slurry is subjected to a spray drying operation to form agglomerated granules of the alumina powder, and the granules then are calcined at an elevated temperature for their consolidation. The alumina containing material comprises $Al_2O_3.nH_2O$, wherein n is in the range of from 0 to 3.

21 Claims, 2 Drawing Sheets

AGGLOMERATION OF ALUMINA MATERIAL

BACKGROUND OF THE INVENTION

1. Field of the Invention

This invention relates to a process for the agglomeration of alumina containing material substantially comprising $Al_2O_3.nH_2O$ where n is in the range of from zero to 3. The invention also relates to agglomerated granules produced by that process.

2.Description of the Prior Art

Fine powder or dust of such alumina containing material (herein called "alumina powder") is difficult to handle and has poor flow characteristics. As a consequence, by-product alumina powder from the Bayer process presents difficulties. In the Bayer process, precipitated alumina trihydrate is filtered, dried and calcined to yield high purity alumina product of a relatively narrow size spectrum, for use in an electrolytic smelting operation. By-product alumina powder, referred to as fines, superfines and sometimes as ESP dust, is recovered by multicyclones and/or electrostatic precipitator collectors from the calcining stage and typically has an average particle size of less than 30 $\mu$m. In addition to being difficult to handle and having poor flow characteristics, by-product alumina powder can not be readily digested if recycled to the hot caustic digestion stage of the Bayer process. Also, if added to the alumina product for use in the smelting operation, it increases the size range and dustiness of the product.

There is a need to be able to agglomerate alumina powder into a coarser product of a size range which approximates the preferred size range for the smelting operation. However, there also can be benefit in ceramics manufacturing in being able to agglomerate fine alumina powder, whether this is ESP dust or is from another source.

In ceramics manufacturing, fine micron sized ceramic powders are agglomerated by spray drying, using an organic polymer, such as PVA, as a binder. The purpose, however, is to make weak granules that act as a flowable precursor to facilitate pressing of low porosity green bodies of ceramics, prior to firing. However, these granules are essentially friable and weakly bonded, and may be degraded when handled or transported. Thus, agglomeration with such organic polymers is of limited benefit.

We have found that alumina powder can be agglomerated by use of a suitable inorganic binder.

SUMMARY OF THE INVENTION

According to the invention, there is provided a process for agglomerating powder (herein referred to as "alumina powder") comprising alumina containing material, using a binder comprising a polymer form of a hydroxy salt of aluminium. In the process, an aqueous slurry of the alumina powder, containing a sufficient quantity of the binder, is subjected to a spray drying operation to form agglomerated granules, and the granules then are calcined at an elevated temperature for their consolidation; the alumina material comprising $Al_2O_3.nH_2O$ where n is in the range of from zero to 3.

DETAILED DESCRIPTION OF THE INVENTION

The alumina containing material may be fully dehydrated alumina, fully hydrated alumina, partially hydrated alumina or a mixture of these forms. Where resulting from calcination of alumina trihydrate, the material may be of high purity. However, the material may be other than of high purity, comprising for example relatively high grade bauxite fines or powder. Where the alumina containing material is other than of high purity, it preferably has an alumina content (calculated as $Al_2O_3$, i.e. with n being zero) of at least about 80 wt %.

The alumina powder may comprise ESP dust resulting from calcining trihydrate in the procedure of the Bayer process. However, the alumina powder may be from other sources. The alumina powder may have an average particle size of less than 30 $\mu$m, although alumina powder of larger particle size can be used, subject to its suitability for spray drying.

The polymer used as the binder preferably is one based on units such as of the form $Al_x(OH)_y^{(3x-y)+}$. The polymer can be formed by the action of a base such as NaOH on a suitable aluminium salt, such as the chloride, nitrate, sulphate or oxalate. Alternatively, the polymer can be formed by the action of an acid on a suitable aluminium compound such as alumina trihydrate. In each case, the action of the base or acid is to form hydroxy aluminium species. At relatively low pH levels, the species tend to be in solution as a monomer, such as $Al(OH)_3$. At increased pH levels, such as in excess of about pH3, polymers of the general form $Al_x(OH)_y^{(3x-y)+}$ tend to form and to increase in molecular weight with both pH and time. At a pH in excess of about 6 the polymer tends to form a visible precipitate of complex polymer forms, to provide a colloidal suspension. Also, the polymer generally is hydrated, with the extent of hydration appearing to vary with the level of polymerization.

The binder necessitates control over the pH of the slurry in order to ensure it is present in a suitable polymerized form to provide the required functioning as a binder. At low slurry pH levels, such as below about pH 3.0, the binder typically is present essentially as a monomer and does not function as binder. The slurry preferably has a pH in excess of pH 3, such as in excess of pH 3.5 and preferably of at least 4 to ensure agglomerated granules of sufficient integrity. At high pH levels, the polymer is found to be excessively polymerized, such that it is present as non-binding species. To avoid this, it is desirable that the pH be less than about 10, preferably less than about 8.5. Accordingly, the pH of the slurry desirably is from about 3 to about 10, preferably from about 3.5 to about 8.5, and most preferably from about 4 to about 6.

While the binder tends to be present as a visible precipitate at higher pH levels, this is found not to detract from its functioning as a binder when used in accordance with the invention with a slurry having a higher pH. This, of course, assumes that the pH of the slurry is not so high as to result in the binder forming non-binding species. It appears that the precipitate forms on or adheres to particles of the alumina powder of the slurry such that the precipitate is available to function as a binder.

It is found that, under some circumstances, a pH in excess of about 6 can result in granules which do not maintain adequate integrity. In general, this occurs when the alumina powder is relatively coarse, such as alumina powder having an average particle size in excess of about 30 $\mu$m. However, where this is the case, there are two options available, namely:

(i) to restrict the pH range to an upper limit of about 6, (ii) to include in the alumina powder a sufficient proportion of alumina powder of less than 30 $\mu$m, such as a sufficient portion of ESP dust, or (iii) to utilize a variant of the invention detailed later herein.

Where option (ii) is adopted, the proportion of alumina powder of less than 30 $\mu$m can range up to at least about 10 wt % relative to the weight of coarser alumina powder.

The pH of an aqueous slurry of alumina powder, as formed, can be as high as about 11. The pH is adjusted to a value in the required range, preferably before addition of the binder. This adjustment may be by addition of a suitable acid, such as hydrochloric acid. Other suitable acids include, nitric, formic and oxalic acid.

The alumina powder solids content of the slurry can vary in accordance with normal requirements for spray drying. The maximum solids content is determined by slurry viscosity and ranges from about 48 wt/volume % to about 56 wt/volume %.

The level of binder required in the slurry can vary widely. It can range, in $Al_2O_3$ solids equivalent, up to 30 wt % binder relative to the wt % of alumina powder, although higher levels can be used, if required. The lower level of binder, in $Al_2O_3$ equivalent, is preferably about 10 wt %, relative to the wt % of alumina powder, in order to achieve satisfactory agglomeration, although lower levels down to an $Al_2O_3$ solids equivalent of about 2.5 wt % can be used, if required. However, where the solids equivalent is less than 10 wt %, it generally is necessary to have recourse to the above-mentioned variant of the invention.

As indicated, the binder preferably is added after the alumina powder slurry has been formed, and the pH of the slurry has been adjusted to the required range. In such case, the binder may be added as an aqueous solution or dispersion of a suitable concentration, such as of 40 to 60 wt/v %. The binder can be formed as summarised above based on use of for example alumina trihydrate and a suitable acid or an aluminium compound such as the chloride and a suitable base. However, as an alternative to adding the binder after the alumina powder slurry has been formed, the binder can be formed in situ by charging the trihydrate and/or alumina powder, such as ESP dust, and also a suitable acid solution to a reactor to form an acidic aluminium hydroxide solution (i.e. binder monomer). The alumina powder to be agglomerated then is added to the acidic solution to form the slurry, and to neutralize the acid to pH level suitable for polymerisation of the binder. In either case, it will be appreciated that it generally will be necessary to add an appropriate amount of a suitable dispersant to facilitate slurrying of the alumina powder, as also is desirable where pre-formed binder is added to an alumina powder slurry.

The agglomerated granules produced by spray drying can be calcined at temperatures at least up to about 1200° C. Calcining at temperatures in excess of 1200° C. can be used, at correspondingly reduced calcining times, but in general do not achieve any enhancement in attrition resistance of the resultant granules. At calcining temperatures below about 600° C., the granules may not have optimum attrition resistance. A calcining temperature of at least about 600° C. therefore generally is desirable, although about 800° C. to 850° C. is a preferred minimum calcining temperature if excessive calcining times are to be avoided. The calcining temperature most preferably is from about 900° C. to 1200° C. to ensure adequate to good attrition resistance.

References are made above to a variant of the invention. The variant is particularly applicable where the level of binder is less than about 10 wt % solids as $Al_2O_3$ equivalent. However the variant can be used, if required, where the binder is used at higher levels. The variant also is particularly applicable where the alumina powder to be agglomerated is or includes ESP dust, although it also is applicable where an alternative source of alumina powder is included. Additionally, the variant facilitates use of the binder at pH levels in excess of 6, such as at a pH up to about 8.

In the variant, the alumina powder to be agglomerated comprises a blend of alumina powder as previously considered (essentially unactivated alumina) with activated alumina. The blend can be formed prior to or in forming the slurry. The activated alumina may comprise up to about 50 wt %, or more, of the alumina powder to be agglomerated but preferably does not exceed about 60 wt %. The activated alumina preferably is present at at least about 5 wt %, such as from about 10 to about 50 wt %.

The activated alumina may have an average particle size similar to that of the unactivated alumina powder. However, the activated alumina preferably has a lesser average particle size. Thus with, for example, ESP dust having an average particle size less than about 30 $\mu$m, but in excess of about 10 $\mu$m, activated alumina having an average particle size of from about 10 $\mu$m down to about 2 $\mu$m can be used.

The activated alumina particles preferably react to form a gel with water, which acts to cement together particles of the unactivated alumina powder. To assist in forming such gel, the activated alumina preferably has an average particle size which is less than that of the unactivated alumina powder, or at least a significant proportion of fines facilitating gel formation. The resultant granules thus typically comprise aggregated particles coated with a film, with the film resulting from reaction of the activated alumina with water and typically exhibiting the form of pseudo boehmite crystals.

At least where, in the variant of the invention, the binder is present at an $Al_2O_3$ solids equivalent of less than about 10%, the agglomerated granules resulting from spray drying and calcining can exhibit an insufficient resistance to attrition. However, it is found that resistance to attrition can be enhanced to a suitable level by subjecting the granules to an aging step prior to calcining. Specifically, it is found that this is achieved by aging the spray dried granules in steam for a sufficient time, such as at a temperature of from about 70° C., such as from 70° to 80° C. Depending on the actual temperature of the aging step, aging to from 1 to 2.5 hours can be appropriate.

At least where based on use of high purity alumina powder, the granules have the benefits of being white and substantially free of metal species other than aluminium. Each of these factors are desirable where the granules are for addition to alumina product for smelting or for use in ceramics production.

The invention is further illustrated by the following Examples, in which:

ESP designates a variable mixture of alumina, alumina hydrates and partially hydroxylated alumina, comprising ESP alumina dust samples obtained by electrostatic precipitators of a commercial Bayer process operation.

A.A. designates activated alumina prepared by injecting 500 gm quantities of 7$\mu$ alumina into a 2.7 m long, flash calcination tube furnace of 75 mm diameter, with recovery in a cyclone with underflow valve open or closed to alter quenching temperature, tube residence time variation from 0.05 to 0.10 sec., and samples sealed in tins until required.

CP3 designates 3 $\mu$m activated alumina available from Aluminium Company of America.

EXAMPLES 1 TO 14

In this series of Examples, aqueous slurries were prepared with a range of alumina powders. The slurry compositions are set out in Table 1.

TABLE 1

| Example | Slurry Composition | Binder % Soln. | Binder % Solids Equiv. | Binder $Al_2O_3$ Equiv. Solids | pH |
|---|---|---|---|---|---|
| 1 | ESP + $Al_2(OH)_5Cl$ | 20 | 10 | 5.8 | 4 |
| 2 | ESP + $Al_2(OH)_5Cl$ | 40 | 20 | 11.6 | 4 |
| 3 | ESP + $Al_2(OH)_5Cl$ | 60 | 30 | 17.4 | 4 |
| 4 | ESP + $Al_2(OH)_5Cl$ | 40 | 20 | 11.6 | 6 |
| 5 | ESP + $Al_2(OH)_5Cl$ | 40 | 20 | 11.6 | 8 |
| 6 | 50/50 ESP/AA + $Al_2(OH)_5Cl$ | 10 | 5 | 2.9 | 4 |
| 7 | 80/20 ESP/AA + $Al_2(OH)_5Cl$ | 10 | 5 | 2.9 | 4 |
| 8 | 90/10 ESP/AA + $Al_2(OH)_5Cl$ | 10 | 5 | 2.9 | 4 |
| 9 | ESP + $Al_2(OH)_5Cl$ | 5 | 2.5 | 1.5 | 4 |
| 10 | 80/20 ESP/AA + $Al_2(OH)_5Cl$ | 5 | 2.5 | 1.5 | 4 |
| 11 | 50/50 ESP/AA + $Al_2(OH)_5Cl$ | 5 | 2.5 | 1.5 | 4 |
| 12 | 50/50 ESP/CP3 + $Al_2(OH)_5Cl$ | 5 | 2.5 | 1.5 | 4 |
| 13 | ESP + $Al_2(OH)_5Cl$ | 40 | 20 | 11.6 | 8 |
| 14 | ESP + $Al_2(OH)_5Cl$ | 20 | 10 | 5.8 | 8 |

The slurries were spray dried. Following this, selected samples were calcined in a muffle furnace for 1 hour at 600° C., 800° C., 900° C., 1000° C. and 1200° C.

In each case, the slurry subjected to spray drying comprised approximately 2 kg of alumina powder dispersed in water by use of a conventional dispersant. Hydrochloric acid was then added to the slurries to adjust the pH to 4, 6 or 8, after which binder was added to achieve a binder solids content, as $Al_2O_3$ equivalent, relative to the alumina powder of the slurry of from 2.5 to 30 wt %. The binder use was aluminium hydroxchloride, having an empirical formula of $Al_2(OH)_5Cl$. The maximum solids content of the slurries was dictated by the need for an acceptable viscosity and, in each case, ranged from 48 to 56 wt/v %. During spray drying, the inlet gas temperature was about 180° C., and the exit gas temperature was about 130° C. From full data obtained, important features are discussed in the following.

Based on Examples 9, 1, 2 and 3, respectively, binder level was tested at 2.5%, 10%, 20% and 30% at pH 4. The granules produced at the 2.5% binder level collapsed on handling after spray drying, but before calcining. However, the granules at the other binder levels were able to be handled and, after calcining, found to have good resistance to attrition. Granules obtained with Examples 13 and 14, with respective binder levels of 20% and 10% at pH 8, were calcined at various temperatures up to 1200° C. After calcining, the attrition resistance of the granules was measured by screening for 20 minutes using a set of standard root 2 sieves on a Rotap shaker. Representative results are set out in Tables 2a (Example 13) and Table 2b (Example 14).

TABLE 2a

| Drying/Calcination (°C.) | 150 | 150 | 600 | 800 | 900 | 1000 | 1200 |
|---|---|---|---|---|---|---|---|
| Attrition Time (Min.) | 5 | 20 | 20 | 20 | 20 | 20 | 20 |
| Size Range (microns) | % Retained | % Retained | % Retained | % Retained | % Retained | % Retained | % Retained |
| −300/+212 | 12.25 | 7.05 | 4.70 | 5.75 | 5.35 | 9.93 | 11.80 |
| −212/+150 | 24.05 | 22.27 | 20.54 | 21.36 | 23.26 | 20.40 | 20.65 |
| −150/+106 | 25.39 | 28.41 | 27.23 | 28.19 | 28.07 | 25.74 | 27.43 |
| −106/+75 | 25.84 | 26.14 | 26.98 | 26.03 | 27.01 | 28.49 | 25.37 |
| −75/+53 | 11.36 | 13.41 | 14.36 | 12.57 | 12.83 | 13.97 | 12.09 |
| −53 | 1.11 | 2.73 | 6.19 | 6.10 | 3.48 | 1.47 | 2.65 |
| | 100% | 100% | 100% | 100% | 100% | 100% | 100% |

TABLE 2b

| Drying/Calcination (°C.) | 150 | 150 | 600 | 800 | 900 | 1000 | 1200 |
|---|---|---|---|---|---|---|---|
| Attrition Time (Min.) | 5 | 20 | 20 | 20 | 20 | 20 | 20 |
| Size Range (microns) | % Retained | % Retained | % Retained | % Retained | % Retained | % Retained | % Retained |
| −300/+212 | 11.49 | 0.45 | 0.51 | 6.65 | 4.48 | 4.48 | 6.91 |
| −212/+150 | 22.09 | 21.32 | 20.68 | 22.48 | 21.38 | 21.83 | 18.57 |
| −150/+106 | 26.87 | 28.53 | 27.97 | 27.34 | 27.07 | 27.58 | 25.92 |
| −106/+75 | 24.93 | 25.98 | 27.97 | 26.08 | 27.07 | 26.40 | 27.21 |
| −75/+53 | 12.09 | 13.21 | 14.07 | 12.05 | 13.45 | 14.75 | 15.98 |
| −53 | 2.54 | 10.51 | 8.81 | 5.40 | 6.55 | 4.57 | 5.40 |
| | 100% | 100% | 100% | 100% | 100% | 100% | 100% |

Examples 2, 4 and 5 illustrate performance over the preferred slurry pH range of 4 to 8 to control polymerization of the binder used at a level of 20 wt % $Al_2O_3$ solids equivalent content. Below this range, it was difficult to achieve polymerization while, above the range, binder action was lost due to excessive polymerization. At the respective pH values of 4, 6 and 8 for Examples 2, 4 and 5, granules were calcined and subjected to Rotap screening essentially as for Examples 13 and 14. In each case, the granules calcined at 600° C. were handlable, but showed lower attrition resistance than those calcined at 900° C. or higher. There was little evidence of variation in performance due to variation over the range of pH 4 to 8. Selected data is set out in Table 3.

TABLE 3

| Drying/Calcination (°C.) | 150 | | | 150 | | | 600 | | | 900 | | |
|---|---|---|---|---|---|---|---|---|---|---|---|---|
| Attrition Time (Min.) | 5 | | | 20 | | | 20 | | | 20 | | |
| Size Range | % Retained | | | % Retained | | | % Retained | | | % Retained | | |
| (microns) | Ex2 | Ex4 | Ex5 | Ex2 | Ex4 | Ex5 | Ex2 | Ex4 | Ex5 | Ex2 | Ex4 | Ex5 |
| −300/+212 | 12.94 | 9.01 | 9.52 | 11.80 | 8.29 | 4.90 | 8.66 | 4.00 | 7.35 | 16.33 | 7.63 | 9.04 |
| −212/+150 | 23.90 | 20.31 | 19.55 | 22.96 | 22.03 | 20.62 | 22.83 | 20.67 | 19.85 | 29.25 | 15.25 | 18.07 |
| −150/+106 | 26.54 | 27.28 | 25.56 | 27.25 | 25.37 | 25.90 | 26.77 | 26.67 | 24.26 | 26.53 | 25.42 | 27.11 |
| −106/+75 | 23.46 | 27.52 | 28.07 | 23.61 | 27.23 | 25.51 | 24.41 | 28.00 | 27.94 | 19.05 | 27.12 | 30.12 |
| −75/+53 | 12.28 | 13.46 | 16.04 | 12.45 | 14.11 | 16.88 | 12.99 | 16.67 | 13.24 | 6.12 | 19.49 | 13.86 |
| −53 | 0.88 | 2.40 | 1.25 | 1.93 | 2.97 | 2.19 | 4.33 | 4.00 | 7.35 | 2.72 | 5.08 | 1.81 |

With samples produced by Example 2, using binder at 20% $Al_2O_3$ solids equivalent, XRD analysis conducted on agglomerated granules calcined to 1200° C. indicated in excess of 89% alpha alumina.

Examples 1 to 5, 9 and 13 and 14 show use of the aluminium hydroxchloride based binder acting alone as a binder. In contrast, Examples 6 to 8 and 10 to 12 show use of that binder in combination with activated alumina, with the latter enhancing binding by forming a film of pseudo boehmite which adheres to the particles of the unactivated alumina powder. The activated alumina allows use of less than about 10 wt % $Al_2O_3$ solids equivalent of the $Al_2(OH)_5Cl$ based binder. However, activated alumina is not able to be used alone to achieve beneficial agglomeration of ESP dust. Specifically, the $Al_2(OH)_5Cl$ based binder is necessary to ensure that the agglomerated granules, prior to calcining, have sufficient cohesiveness to promote handleability and resistance to attrition. However, the $Al_2(OH)_5Cl$ based binder also is believed to contribute to resistance to attrition after calcining compared with use, if possible, of activated alumina without $Al_2(OH)_5Cl$ based binder.

Examples 10 to 12 illustrate spray drying tests based on use of activated alumina. In Examples 10 and 11, 7$\mu$ activated alumina powder was used, while that for Example 12 was 3$\mu$ activated alumina powder. In each case, the spray dried agglomerated sample was collected, placed in a steam bath at 80° C. for 2 hours, dried and then calcined at different temperatures for 1 hour.

The sample of Example 10, with an 80/20 ratio of ESP/AA, substantially collapsed when subjected to Rotap screening, indicating a need for a higher level of activated alumina and/or of a higher level of $Al_2(OH)_5Cl$ based binder than the marginal level of 2.5 wt % $Al_2O_3$ solids equivalent. With Example 11, the −53$\mu$ fraction after Rotap screening increased from 3.1% after calcining at 150° C. (in effect, after drying), to 7.7% after calcining at 900° C. For Example 12, the increase for those temperatures was from 5.5% to 6.0%. In summary, the effect of the aging of spray dried agglomerate granules with 50% activated alumina and $Al_2(OH)_5Cl$ based binder at 2.5 wt % $Al_2O_3$ solids equivalent, prior to drying/calcining, as shown by attrition resistance, is similar to use of $Al_2(OH)_5Cl$ based binder, without activated alumina, at higher levels of at least about 10 wt % $Al_2O_3$ solids equivalent. In this regard, it will be noted that the −53$\mu$ fraction of 7.7% for the Example 11 sample calcined at 900° C. is comparable to the −53$\mu$ fraction of 6.55% for the Example 14 sample calcined at 900° C. (see Table 2b).

Attrition testing results by Rotap screen, obtained with Examples 11 and 12, are set out in Table 4.

TABLE 4

| Drying/Calcination (°C.) | 150 | | 150 | | 600 | | 900 | |
|---|---|---|---|---|---|---|---|---|
| Attrition Time (Min.) | 5 | | 20 | | 20 | | 20 | |
| Size Range | % Retained | | % Retained | | % Retained | | % Retained | |
| (microns) | Ex11 | Ex12 | Ex11 | Ex12 | Ex11 | Ex12 | Ex11 | Ex12 |
| 300/+212 | 0.6 | 1.5 | 1.3 | 0.4 | 0.0 | 0.0 | 0.0 | 1.1 |
| −212/+150 | 9.2 | 10.4 | 8.0 | 9.1 | 5.4 | 7.7 | 0.2 | 8.3 |
| −150/+106 | 26.8 | 24.6 | 23.8 | 24.5 | 23.0 | 23.3 | 23.0 | 22.4 |
| −106/+75 | 34.8 | 34.8 | 38.4 | 36.1 | 36.5 | 36.6 | 33.7 | 37.4 |
| −75/+53 | 25.6 | 23.1 | 28.5 | 23.8 | 26.4 | 24.4 | 27.6 | 24.8 |
| −53 | 3.1 | 5.5 | 0.0 | 6.0 | 8.8 | 8.0 | 7.7 | 6.0 |

Examples 6 and 8 show use of activated alumina, at levels corresponding to Examples 10 and 11, but with $Al_2(OH)_5Cl$ based binder at 5% $Al_2O_3$ solids equivalent. However, in the case of Examples 6 and 8, attrition resistance after calcining was tested on samples which had not been subjected to steam aging before calcining. The results are detailed in Table 5, and the high attrition rate (shown by the −53$\mu$ fraction) indicates the need for aging at that level of $Al_2(OH)_5Cl$ based binder. The results of Examples 11 and 12, despite each having a lower level of $Al_2(OH)_5Cl$ based binder, make clear that steam aging contributes to attrition resistance, at least unless the level of $Al_2(OH)_5Cl$ based binder is about 10 wt % $Al_2O_3$ solids equivalent or higher.

TABLE 5

| Calcination (°C.) | Not Calcined | | Not Calcined | | 600 | | 900 | |
|---|---|---|---|---|---|---|---|---|
| Attrition Time (Min.) | 5 | | 20 | | 20 | | 20 | |
| Size Range | % Retained | | % Retained | | % Retained | | % Retained | |
| (microns) | Ex6 | Ex8 | Ex6 | Ex8 | Ex6 | Ex8 | Ex6 | Ex8 |
| −300/+212 | 3.5 | 4.0 | 1.3 | 0.2 | 0.2 | 0.0 | 0.3 | 0.0 |
| −212/+150 | 18.8 | 16.5 | 8.0 | 3.6 | 2.7 | 1.6 | 1.0 | 0.6 |
| −150/+106 | 29.1 | 30.7 | 21.6 | 21.2 | 14.2 | 4.5 | 10.8 | 8.3 |
| −106/+75 | 27.4 | 22.3 | 27.4 | 27.7 | 25.8 | 15.3 | 32.1 | |
| −75/+53 | 15.3 | 14.4 | 15.4 | 20.8 | 15.0 | 12.8 | 18.4 | |
| −53 | 5.6 | 11.9 | 26.1 | 26.4 | 41.7 | 65.7 | 37.1 | |

BRIEF DESCRIPTION OF THE DRAWINGS

The accompanying Figures show four representative photomicrographs, in which:

FIG. 1 shows clearly the excellent sphericity of the agglomerated alumina grains obtained by the present invention. While FIG. 2 shows evidence of some fine gaps (or cracks) in the granules as calcined at 600° C., FIG. 3 shows little evidence of such gaps after calcination at 900° C.

Comparison of FIGS. 3 and 4, for which the originating alumina powder slurries had been adjusted respectively to pH 8 and 4, indicates similar overall agglomeration. However, FIG. 4 shows less evidence of small 0.2$\mu$ "clumps" on the surface of particles of the granules.

EXAMPLES 15 TO 17

Figure 1:
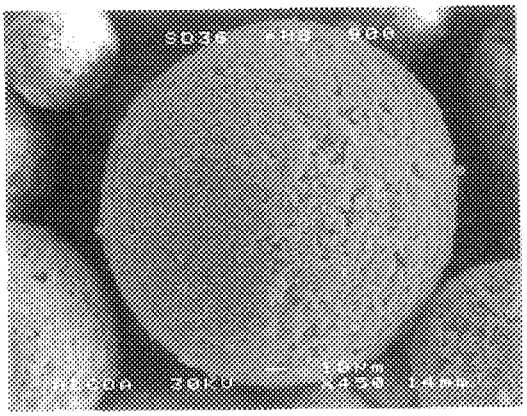
FIG. 1 is based on a sample of Example 5 calcined at 900° C., at a magnification of X450.

These further Examples were to identify the range of conditions, in terms of pH and temperature, required to produce handleable microgranules of alumina powder comprising ESP dust. As in the previous Examples, slurries of the alumina powder were spray dried, using as binder aluminium hydroxychloride polymer. In each case, the binder was added as a 20% solution, providing 10% solids equivalent of the polymer (5.8% $Al_2O_3$ solids equivalent). The slurry pH for the Examples was 4, 6 and 8, respectively.

The pH range was restricted to an upper limit of 8, since pH values above 8 were found to increase the viscosity of the slurry. The increase was to such an extent that the slurry could not be pumped using the peristaltic pump employed for pumping the slurries from a sump to a standard, twin fluid atomiser nozzle mounted on the spray drying installation. The spray dryer used in these, and also Examples 1 to 14, was constructed of stainless steel, and had a height of about 5.0 m and a diameter of about 0.8 m. It employed a radial fan to provide the counter-current air flow required for drying. An LPG burner was used to heat the counter-current air, while compressed air was supplied to the nozzle to atomise each slurry during drying.

After spray drying, but before calcining, a standard sample splitting technique was used to split a respective representative sample, of about 80 g, from the bulk of microgranule product produced for each slurry. Each representative sample was then subjected to size analysis by being screened for a period of 5 minutes, using a set of standard root 2 sieves of a "Rotap" screen shaker. The results are detailed in Table 6.

TABLE 6

| | Example 15 (pH 4) | | Example 16 (pH 6) | | Example 17 (pH 8) | |
|---|---|---|---|---|---|---|
| Rotap Screen Size ($\mu$m) | wt (g) | Cumulative % Passing | wt (g) | Cumulative % Passing | wt (g) | Cumulative % Passing |
| 2360 | 0.00 | 100.00 | 0.00 | 100.00 | 0.00 | 100.00 |
| 1800 | 0.00 | 100.00 | 0.00 | 100.00 | 0.02 | 99.97 |
| 1180 | 0.00 | 100.00 | 0.00 | 100.00 | 1.12 | 98.06 |
| 850 | 0.00 | 100.00 | 0.05 | 99.95 | 3.05 | 92.85 |
| 600 | 0.02 | 99.98 | 2.60 | 97.12 | 5.84 | 82.89 |
| 425 | 3.40 | 96.37 | 3.46 | 93.35 | 7.64 | 69.86 |
| 300 | 5.20 | 90.85 | 4.19 | 88.79 | 7.70 | 56.72 |
| 212 | 5.40 | 85.11 | 4.96 | 83.40 | 7.44 | 44.03 |
| 150 | 5.61 | 79.15 | 6.33 | 76.51 | 8.38 | 29.73 |
| 106 | 12.52 | 65.86 | 12.94 | 62.43 | 6.74 | 18.24 |
| 75 | 21.90 | 42.60 | 23.14 | 37.25 | 4.53 | 10.51 |
| 53 | 24.72 | 16.34 | 23.68 | 11.49 | 2.94 | 5.49 |
| 53 | 15.39 | 0.00 | 10.56 | 0.00 | 3.22 | 0.00 |
| Total | 94.16 | | 91.91 | | 58.62 | |
| AverageSize | | 123.35$\mu$m | | 143.50$\mu$m | | 353.37$\mu$m |

As can be seen from the values indicated at the foot of Table 6, the average size increased with slurry pH. The variation in average size with pH is caused by the change in the slurry elastic viscosity with pH, and demonstrates how the "coarseness" of the spray dried product can be controlled.

From plots of the size distributions of Table 6, i.e. of cumulative % passing against screen size, it is evident that the product of Examples 15 and 16 have a sharp inflection point at around the 100 $\mu$m size. This indicates that a large percentage of the microagglomerate produced in those Examples lies in the very fine end of the size range (−53 $\mu$m). A similar plot for Example 17 is a much flatter curve, indicating that less fine agglomerates are produced at about pH 8 than at pH 4 and pH 6 as used for respective Examples 15 and 16. The product for each Example was within Smelter Grade Alumina (SGA) size range requirements, and was flowable and dedusted. However, the results of Table 6 indicate that the relatively high pH of 8 used for Example 17 is the most suitable to produce agglomerates suitable for SGA inclusion. Also, of course, a higher pH has the cost benefit of minimising acid consumption.

After spray drying of each slurry, a respective selected sample of resultant microspheres was then calcined in a muffle furnace as used for Examples 1 to 14. Calcining was for 1 hour at 600° C., 800° C., 900° C., 1000° C. or 1200° C. Using a simple Rotap screening test on duplicate samples for 5 or 30 minutes, resistance to attrition was determined by obtaining attrition values (AV) by the following calculation:

$$AV = \frac{100(x-y)}{100-y}$$

where x is the sample −53 μm wt % after 30 minutes and y is sample −53 μm wt % after 5 minutes. The results obtained are summarised in Table 7, showing variation in AV with drying or calcination temperature.

TABLE 7

| Drying/ Calcination | Attrition Value (%) | | |
|---|---|---|---|
| (°C.) | Ex. 15 (pH 4) | Ex. 16 (pH 6) | Ex. 17 (pH 8) |
| 150 | 0.50 | 0.55 | 10.03 |
| 600 | 0.38 | 0.05 | 5.07 |
| 800 | 0.21 | 0.06 | * |
| 900 | 0.07 | 0.09 | 4.17 |
| 1000 | 1.44 | 1.47 | 6.82 |
| 1200 | 0.74 | 1.50 | 4.56 |

*To be determined

In relation to the results detailed in Table 7, it is to be noted that the lower the AV, the more resistant to attrition are the granules. It is evident from Table 7 that for Examples 15 and 16, calcination up to about 900° C. provides granules with the greatest resistance to attrition. However, these Examples required a relatively large acid addition to adjust the slurry to the respective pH levels of 4 and 6, and this adds to the process cost. Indications are that an optimal pH range, when cost is factored in, lies between 6 and 8, with an optimal calcination temperature for the spray dried microgranules being between 800° C. and 900° C.

The surface area of the spray dried and calcined microgranules of Examples 15 to 17 was measured using a standard BET technique. The results, shown in Table 8, indicate that calcination to 900° C., of microgranules produced by spray drying a slurry at pH 8, results in microgranules with a surface area inside the range specified for inclusion in SGA. Table 8 also includes, for comparison, selected surface area determinations for the ESP dust used and for the microgranules of Examples 4 (pH 6) and 13 (pH 8).

TABLE 8

| Drying/ Calcination | Surface Area ($m^2/g$) | | | | | |
|---|---|---|---|---|---|---|
| (°C.) | ESP | Ex. 15 | Ex. 16 | Ex. 17 | Ex. 4 | Ex. 13 |
| Nil | 46.96 | | | | | |
| 150 | | 41.63 | * | 37.86 | | |
| 600 | | 103.08 | 135.64 | 92.50 | | |
| 800 | 34.36 | 103.67 | 92.22 | 80.25 | 56.60 | 36.85 |
| 900 | | 65.10 | * | 62.14 | | |
| 1000 | | 47.52 | 43.34 | 48.35 | | |
| 1200 | 19.89 | 3.80 | 7.90 | 8.04 | | |

*Value to be determined.

Table 9 shows the slurry pH for Examples 15 to 17 and for Examples 4 and 13. Table 9 also shows, in each case, the magnitude of the increase in surface area (ISA) of resultant spray dried microgranules calcined at 800° C. over the surface area of ESP dust calcined at 800° C. The trend evident in these results indicate that surface area of microgranules, calcined at 800° C. or higher, may be manipulated by adjustment of slurry pH. These results also highlight the increase in surface area able to be achieved by pH control, with that increase resulting from an increase in solids content of only about a 5.8 wt % $Al_2O_3$ equivalent.

TABLE 9

| Example | 15 | 16 | 17 | 4 | 13 |
|---|---|---|---|---|---|
| Slurry pH | 4 | 6 | 8 | 6 | 8 |
| SA ($m^2/g$) | 69.31 | 57.86 | 45.89 | 22.24 | 2.49 |

The α-alumina content of the microspheres of Examples 15 to 17 was determined using XRD. Table 10 shows a relationship between α-alumina content and the pH of the slurry used for spray drying, as well as selected data for the ESP dust used.

TABLE 10

| Drying/ | α-Alumina (%) | | | |
|---|---|---|---|---|
| Calcination (°C.) | ESP | Ex. 15 (pH 4) | Ex. 16 (pH 6) | Ex. 17 (pH 8) |
| Nil | 13.0 | | | |
| 150 | | 10.3 | 11.0 | 12.0 |
| 600 | | 12.3 | 15.0 | 11.0 |
| 800 | | 12.3 | 15.0 | 12.0 |
| 900 | | 14.3 | 15.0 | 12.0 |
| 1000 | | 29.0 | 31.0 | 22.7 |
| 1200 | 67.7 | 96.6 | 97.0 | 82.3 |

From the data of Table 10, it can be seen that α-alumina formation is low for microspheres calcined at temperatures of up to 900° C. Higher calcination temperatures produce an increase in α-alumina content with a maximum being reached of 97% α-alumina for microspheres formed with the slurry of Example 16 (pH 6) and subsequently calcined to 1200° C. The implication is that it is possible to form microspheres with a high α-alumina content, nominally at a calcination temperature of 1200° C., as also reflected by Table 10, whereas ESP dust per se does not fully convert to α-alumina when calcined under the same conditions. In this case, the size enlargement step, spray drying, has not only contributed to improved handleability of the alumina powder but has also enabled the final product to have a different morphology to that of the alumina powder starting material.

Figure 2:
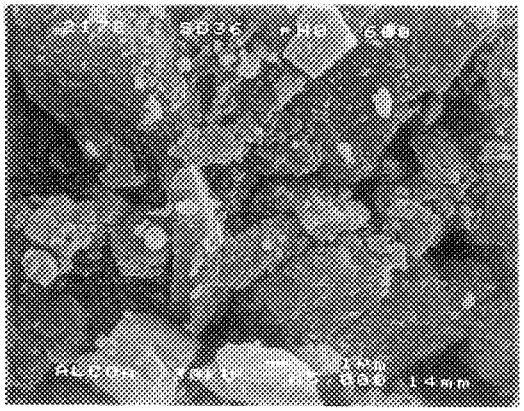
FIGS. 2 and 3 are based on samples of Example 5 calcined respectively at 600° C. and 900° C., and each but are at a magnification of X5,000.
Figure 3:
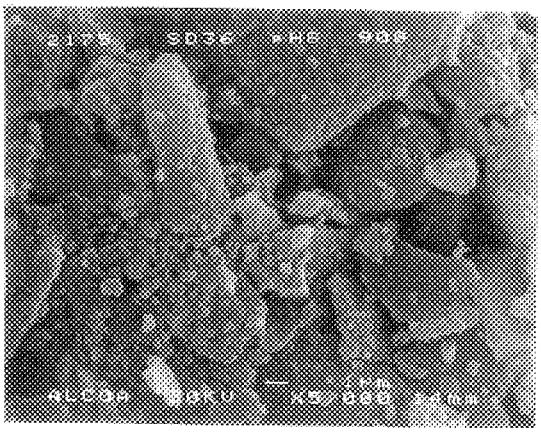
Figure 4:
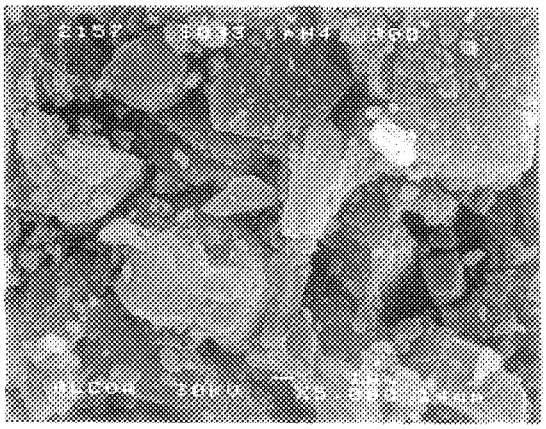
FIG. 4 is based on a sample of Example 2, calcined at 900° C., at a magnification of X5,000.

The agglomerated alumina granules provided by the invention typically are well suited for addition to alumina fed to an electrolytic smelting operating for recovery of aluminium. The process of the invention thus is well suited for overcoming the problem of handling by-product ESP dust from a Bayer process operation. Also, the granules of the invention are suitable for use as "seeds" in the Bayer process for the precipitation of $Al(OH)_3$ from supersaturated sodium aluminate solution. In the latter context, it will be appreciated from FIGS. 1 to 4 that the high surface area of the granules makes them highly suitable for providing nucleation sites for that precipitation. However, the granules also are believed to be suitable for use in a variety of applications in ceramics manufacturing, given their good attrition resistance and, due to that resistance and their sphericity, the ease with which they are able to be screened to provide a required size fraction.

Finally, it is to be understood that various alterations, modifications and/or additions may be introduced into the constructions and arrangements of parts previously described without departing from the spirit or ambit of the invention.

We claim:

1. A process for the agglomeration of powder of alumina containing material, comprising:

forming an aqueous slurry of the powder of alumina containing material, the slurry containing an inorganic binder comprising a polymer of a hydroxy salt of aluminum in a sufficient quantity to agglomerate the alumina containing material;

spray drying the slurry to form agglomerated granules of the powder of alumina containing material; and consolidating the granules by calcining at an elevated temperature; the alumina containing material comprising $Al_2O_3.nH_2O$ where n is in the range of from zero to 3.

2. A process according to claim 1, wherein the binder is formed by reacting a base with an aluminum salt to form hydroxy aluminum species.

3. A process according to claim 2, wherein the aluminum salt is selected from the group consisting of aluminum chloride, aluminum nitrate, aluminum sulfate, and aluminum oxalate.

4. A process according to claim 1, wherein the binder is formed by reaction of an acid with an aluminium compound to form hydroxy aluminium species.

5. A process according to claim 4, wherein the aluminum compound is alumina trihydrate.

6. A process according to claim 1, wherein the powder of alumina containing material comprises ESP dust.

7. A process according to claim 1, wherein the binder is aluminium hydroxychloride polymer.

8. A process according to claim 1, wherein the slurry has a pH of from 3 to 10.

9. A process according to claim 8, wherein the slurry has a pH of from 3.5 to 8.5.

10. A process according to claim 8, wherein the slurry has a pH of from 4 to 8.

11. A process according to claim 1, wherein the binder is present in the slurry at up to 30 wt %, in $Al_2O_3$ solids equivalent, relative to the content of powder of alumina containing material.

12. A process according to claim 11, wherein the binder is present in the slurry at from 2.5 to 10 wt %, in $Al_2O_3$ solids equivalent, relative to the content of powder of alumina containing material.

13. A process according to claim 1, wherein said powder of alumina containing material comprises essentially unactivated alumina and the slurry contains up to 60 wt % activated alumina.

14. A process according to claim 13, wherein the slurry contains at least 5 wt % activated alumina.

15. A process according to claim 14, wherein the slurry contains from 5 to 50 wt % activated alumina.

16. A process according to claim 13, wherein the activated alumina has an average particle size less than the average particle size of the essentially unactivated alumina.

17. A process according to claim 13, wherein the powder of alumina containing material comprises ESP dust having an average particle size from 10 $\mu$m to 30 $\mu$m, and activated alumina having an average particle size of from 2 $\mu$m to 10 $\mu$m.

18. A process according to claim 13, wherein the granules are subjected to ageing, by exposure to steam for a time sufficient to enhance their resistance to attrition, prior to calcining.

19. A process according to claim 1, wherein the granules are calcined at a temperature of from 600° C. to 1200° C. for a time sufficient to achieve consolidation.

20. A process according to claim 19, wherein the granules are calcined at a temperature of from 800° C. to 1200° C.

21. A process according to claim 1, wherein the powder of alumina containing material has an average particle size of less than 30 $\mu$m.

* * * * *